United States Patent [19]

DeCloux

[11] Patent Number: 4,919,416

[45] Date of Patent: Apr. 24, 1990

[54] DUAL FACING AEROBIC EXERCISE MACHINE

[76] Inventor: Richard J. DeCloux, 1485 Belmont St., Manchester, N.H. 03104

[21] Appl. No.: 311,079

[22] Filed: Feb. 14, 1989

[51] Int. Cl.[5] ..... A63B 23/06

[52] U.S. Cl. ..... 272/69; 272/70; 272/93; 272/130

[58] Field of Search ..... 272/54, 69, 70, 93, 272/112, 130

[56] References Cited

U.S. PATENT DOCUMENTS

| | | | |
|---|---|---|---|
| 2,111,339 | 3/1938 | Squires | 272/54 X |
| 2,871,914 | 2/1959 | Timoney | 272/70 |
| 3,223,413 | 12/1965 | Whitney | 272/93 X |
| 3,287,016 | 11/1966 | Mayer | 272/93 |
| 3,323,796 | 6/1967 | Carlson | 272/93 X |
| 3,606,315 | 9/1971 | Green | 272/112 |
| 4,616,823 | 10/1986 | Yang | 272/73 |
| 4,838,543 | 6/1989 | Armstrong et al. | 272/70 |

OTHER PUBLICATIONS

"Twist—A—Way", by Marcy, Marcy Institutional Catalog, 1979, p. 13.

*Primary Examiner*—Richard J. Apley
*Assistant Examiner*—Joe H. Cheng
*Attorney, Agent, or Firm*—Robert K. Tendler

[57] ABSTRACT

Dual facing diammetrically-opposed either independently activatable or electrically or mechanically linked exercise stations are provided on a common base so diammetrically-opposed users can have an unobstructed view of each other and so that common components can serve each station. The dual facing machines having common structural components, common energy absorption components, common housing components, common hand rail components and common instrument components provide for diammetrically-opposed users in a close relationship so that both social as well as face-to-face competitive exercise is acheivable through interactive control of the exercise stations. Dual facing machines include dual stairclimbing devices, dual exercise bicycles, dual rowing machines or dual tread mill devices.

3 Claims, 7 Drawing Sheets

DUAL FACING AEROBIC EXERCISE MACHINE

FIELD OF THE INVENTION

This invention relates to aerobic exercise equipment and, more particularly, to a dual station space saving structure that can provide interactive exercise and that significantly reduces cost of manufacture.

BACKGROUND OF INVENTION

Aerobic exercise has become a way of life in America, and is fast becoming a major interest of Japanese and European society. Exercise equipment has become more effective and often more desirable in competition with running, aerobic dancing, etc. There are approximately 10,000 health clubs in the United States, and a recent trade association survey of members indicates that aerobic equipment topped the list of amenities to be added to health club equipment.

To win the competition with running and aerobic dancing, aerobic exercise equipment has had to become much more sophisticated, and as a result has become more costly. When used in health clubs and other multi-user institutions, exercise equipment requires exceptional ruggedness and resistance to abuse. As a result, exercise equipment intended for institutional use has grown in cost because of both sophistication and ruggedness requirements.

The cost of manufacturing aerobic exercise equipment in general can be conveniently grouped in the following categories of components: energy absorption, e.g. shunted motor generators to stress the user; structure, e.g. frames, to support the user and resist the forces that use produces; instrumentation to report and control exercise activity; and aesthetics, e.g. covers.

Aside from cost, one of the main problems with exercise equipment is that it is not used because exercise is not inherently fun. Exercise equipment thus has to have something added to become fun. Like many activities which require motivation, exercise often does better when there is a social or group involvement. The success of aerobic dancing is greatly related to the interaction factor. Health clubs have sought to supply this motivation with competitions such as tennis tournaments and tennis ladders. To bring interaction to machine exercise use, clubs offer ladder-like posted rankings based on numerical accomplishment. They generate interaction, but not as much as the head-to-head competition on a common field of play. It will be noted that people join health clubs to be involved with other people. Other people make exercise more like fun. Often interaction with other people, not exercise, is the primary reason people join health clubs. The more intimate the involvement, the better either the fun or social objectives are met. In the past, the norm is to prevent interactive involvement by providing single-user machines, or ganged machines in which the users either face in the same direction or face away from each other. Thus no social or competitive interactive activity is possible for these machines.

Thus, exercise equipment has existed that accommodates multiple users on a common machine. However, none of the machines have diammetrically-opposed, dual facing independently operable exercise stations which would promote both social and face-to-face interactivity. Moreover, no equipment exists which provides face-to-face competition in sports where none exists normally; such as running, bicycling or rowing where the participants do not normally face each other. Thus, in prior exercise equipment, the users were limited to facing in one direction or away from each other in independent exercise. Machines dedicated to joint activity such as the common seesaw are not flexible enough for the institutional requirements of a user being able to choose either an independent or interactive mode of use. However, one prior art multi-user machine, the Versa Climber, does provide independent stations on a base which more or less face each other. Here, however, there is no suggestion of interactive components and in fact completely independent controls are provided for each exercise station. Also there is no unobstructed view of even the head of a person at another station which prevents interactive exercise.

Note also that in universal apparatus, the individuals are not forced to face each other. Thus, none of the current equipment provides face-to-face use on a common machine, and all aerobic exercise machines require the purchase of a virtually complete second machine if two users are to be accommodated simultaneously.

As to safety, it will be appreciated that aside from the desirability of providing face-to-face interaction between the participants, when providing for single user devices one of the basic problems is the stability of the device. The overturn moment is of course important when various lever arms are extended beyond a point of pivot, such as is common with respect to reciprocating arm exercise stair type devices. Moreover, the weight of the device base must usually be increased so as to prevent vibration and overturning in both longitude and lateral directions. Thus for single exercise devices the mass of the device is oftentimes increased to provide stability, while at the same time not accommodating more than one user. It will be appreciated that the force applied to any exercise device is the mass of the user times gravity plus run acceleration. To this is often added a pull up force when an individual grabs a hand rail which adds to weight and acceleration. Thus, the forces applied can be significant. For instance, stairclimbers used by obesity clinics to fill exercise prescriptions for clients weighing up to and in excess of 400 pounds speak to the increase of user mass which must be accommodated by the exercise machine. Moreover, professional or college football teams use stairclimbing type devices for linemen that weigh up to 330 pounds. This presents a problem for the single user exercise machine in that the structural parts of the machine must withstand both the weight of a heavy individual and the torques he can generate. Note that such athletes can lift over 300 pounds and can accelerate to a 3.5 minute mile in less than a second. It will therefore be appreciated that single user machines must accommodate to such large applied forces.

Another consideration is the length of a lever arm for lever arm actuated exercise equipment. Such lever arm actuated exercise equipment includes a reciprocating arm exercise stair in which the length of the arm is a function of the step height required, and the maximum amount of angular deflection acceptable. The average step is 7 inches in height and a 12 inch or more step is necessary for a full range of motion on a stairclimber. The user's ankles must flex through approximately the same angular rotation as the arm. Experiments indicate that a user finds the angle of rotation becomes uncomfortable when the total arc movement is more than 24°. As a result a minimum length arm must be 30 inches long. Such a machine must thus anticipate 1500 ft. lbs. of torque. When designing the counter-torque machine components, the length of the countering moment arm greatly affects the strength required of the components. As a practical matter of accommodating the user, the counter moment can not begin any closer than 20 inches from the point of application of user force. Therefore if the counter moment arm were just 10 inches beyond the 20 inch contact point on the 30 inch arm, the anti-torque components would be subjected to 1800 lbs. of stress. This is generally so large, that the design requires an extension of the counter moment components, eg. base. By way of example, an extension of the base by 10 inches, reduces the component stress to a more handable 900 lbs. Thus, if two stations are not combined, there can be no advantage taken in terms of half the moment supplied by the other station.

Another problem with single station machines is the problem of tip toward the user. Thus, designers of rotating arm exercise machines must consider counter-torque in relation to the safety concerns of avoiding the possibility of the machine tipping toward the user. While the possibility of users pulling climbers over on top of themselves is remote, even a small lifting of the machine during exercise can cause unbalance and lead to injury.

There are two important tip torques. The first is the torque applied by a user during exercise. The second tip torque occurs when the user leans back away from the machine while holding onto the machine. In each circumstance torque is a function of the distance between the force vector and the point at which the forward portion of the machine comes in contact with the floor. The exercise torques are generally so large in relation to the weight of the single user machine, they require the forward machine/floor contact point for the base to be extended out behind the user so there can be no exercise-induced tip torque. By way of example a four hundred pound user can get his center of gravity 6 inches out behind the forward machine/floor contact point. This will generate 200 ft. lb. of torque. A 100 lb. machine would thus have to have its center of gravity 24 inches away from the forward floor contact point, or a 200 lb. machine would have to have its center of gravity 12 inches from the floor contact point, to counter this tip forward torque. Thus single user machines require cumbersome space-consuming extensions to avoid tipping.

In summary, if the machine design puts the machine/floor contact point some significant distance behind the point at which the user applies force, or to which he can move his center of gravity, all tip concerns are eliminated, but at high cost due to extension of the base of the machine. As will be seen in a dual, diammetrically-opposed exercise station configuration, since an opposing station machine has its center of gravity a significant distance away from the machine/floor contact point of the other machine, the floor contact point for neither station has to be behind the user, and can be some significant distance in towards the center of the combined machine, thereby minimizing machine size and space.

SUMMARY OF THE INVENTION

It is thus a feature of this invention that by use of dual facing, independently active exercise stations, created so that common components serve each station, two diammetrically-opposed users can be accommodated in a closer relationship than currently available, and at a cost significantly less than two single station machines; and at significant space savings.

The subject invention eliminates what would be the rearward portion of each of two individual exercise machines and joins them in a fashion such that each provides the missing function for the other. It also provides common instrumentation that can relate the activity of either station independently, or with the activity of the other station. Also, in some instances, common energy absorption components, such as common motor for dual treadmills, can be used to effectuate cost and space savings.

In one embodiment, the subject invention joins two rotating leg type simulated stairclimbing machines comprised of components that have two fronts and no backs. Moreover, a single supporting frame that has fractionally increased dimensions and number of parts when compared to the frame of a single station machine, accommodates two users whose exercise torques can sum to 2000 ft. lb. In such a machine there are two hand rails formed as arches, requiring no center support. These rails are fractionally longer than, but cost approximately the same as, the rails of a single station machine. Moreover, there is a single housing covering the dual mechanism which is only fractionally longer than a single housing, but has the same five sides, and is thus only fractionally more expensive to manufacture than the housing for a single machine. The dual machine has a single instrument including a single cover, circuit board, microprocessor, Eprom, and power supply, etc. evaluating the activity of each of the dual climbing stations and displaying results to each exerciser independently or in relation to each other, e.g. competitively or cooperatively. This requires two displays, and two sensors, but because of the number of common components, it costs only 20% more than a single machine instrument.

Note, for opposed treadmills, cost savings is immediate with the use of a single drive motor for both belts. Thus, a dual exercise device is provided with two independently active exercise stations where users face each other at either end of a common frame. A common instrument may be provided reporting the activity of each exerciser independently or in relation to the other.

It is a feature of this invention that the common components may be symmetrical in form and provide double the user capacity for less than a 50% increase over the cost of a single station machine. The subject invention offers inherent major cost savings in all of the component categories that make up aerobic exercise equipment.

It is an important feature of this invention that opportunity is provided for significant one-on-one user interaction though diammetrically-opposed exercise stations in which at least unobstructed head view is provided for eye contact.

In summary, dual facing diammetrically-opposed either independently activatable or electrically or mechanically linked exercise stations are provided on a common base so diammetrically-opposed users can have an unobstructed view of each other and so that common components can serve each station. The dual facing machines having common structural components, common housing components, common hand rail components, common instrument components and occasionally common energy absorption components reduce cost, save space, and provide for diammetrically-opposed users in a close relationship so that both social as well as face-to-face competitive exercise is achievable through interactive control of the exercise stations. Dual facing machines include dual stairclimbing devices, dual exercise bicycles, dual rowing machines or dual tread mill devices.

BRIEF DESCRIPTION OF THE DRAWINGS

These and other features of the subject invention will be better understood taken in conjunction with the Detailed Description and the Drawings of which.

DETAILED DESCRIPTION

Figure 1:
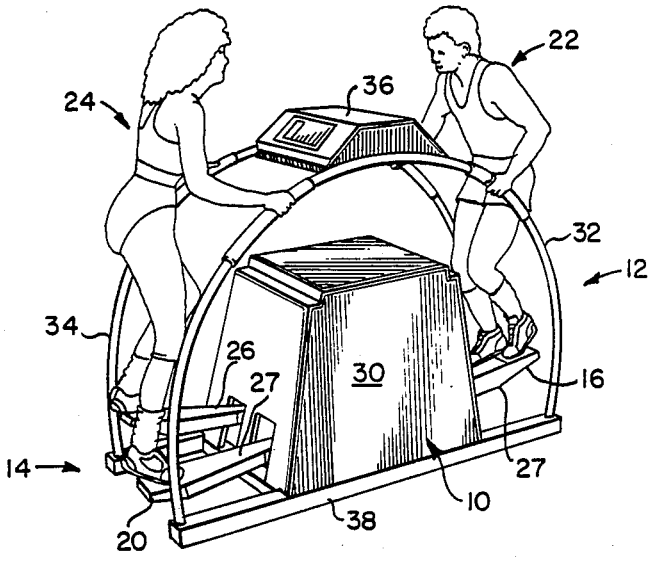
FIG. 1 is a diagrammatic illustration of one type of exercise device, illustrating the dual facing diammetrically opposed independently actuatable or linked stations, illustrating the capability of the exercise machine for establishing interactive exercise between two participants.

Referring now to FIG. 1, interactive as well as dual independent exercise can be achieved on a dual facing diammetrically-opposed stairclimbing machine generally indicated by reference character 10 to include diammetrically-opposed stations 12 and 14 each having active exercising apparatus respectively at 16 and 20 at which respective individuals 22 and 24 are positioned.

In this illustrated embodiment, the machine depicted is one which provides simulated stairclimbing through the foot actuation of pivoted arms 26 and 27 for each of the two stations. It will be appreciated that a single housing 30 houses the apparatus for providing the exercise, whereas a pair of spaced apart arcuate hand rails 32 and 34 provide for the required stability of the user of the machine without having to be duplicated for the dual stations.

These rails carry a unitary instrumentation display and panel 36 which has unitary electronics with a dual display. The display is thus viewable by both participants and can be utilized to control the respective independent exercise apparatus contained in housing 30. Note also that a common base set of rails or tubes 38 accommodate both exercise stations.

What will be immediately apparent is that a single housing, a single set of hand rails, a single base set of rails can be utilized in common for the independent exercise of the two individuals shown. In practical terms what this means is that the cost of providing dual exercise apparatus is drastically reduced. Moreover, as will be seen, the apparatus is inherently safer due to the amount of weight of the machine itself vis-a-vis the contact points of the individuals with the exercise apparatus, such that tipping and other unsafe conditions normally solved by simply beefing up the single station apparatus, is in fact synergistically enhanced by virtue of the combined weight of the apparatus when providing for diammetrically-opposed exercise stations.

Importantly, while the individual stations can be utilized independently with or without opposing individuals and with or without any necessary interaction between these individuals, the subject invention, in the provision of dual facing diammetrically-opposed exercise stations, provides for interaction between the two individuals involved.

Whether this is social interaction which is established through unrestricted face-to-face visibility, or whether a competitive situation is envisaged through the utilization of the common display for the individuals, nonetheless the exercise can be made interactive due to the unrestricted visibility and the face-to-face orientation of the exercise stations.

It is also possible through the utilization of a common instrument cluster and control along with common breaking or torque providing mechanisms within housing 30, that biasing of one set of exercise apparatus with respect to the apparatus at the other station is possible, thereby to provide handicaps for providing equality in exercise for individuals having disparate athletic abilities. Thus in a competitive situation the individuals can be made approximately equal through the utilization of the common apparatus for the two exercise stations.

Figure 2A:
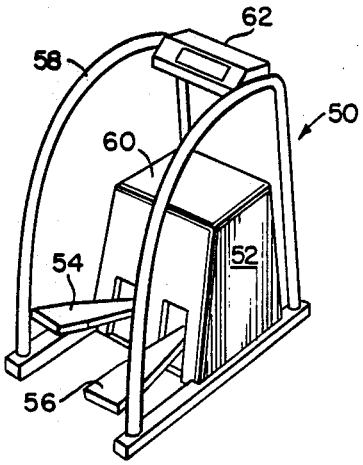
Fig. 2A (PRIOR ART)
FIG. 2A is diagrammatic illustration of a prior art single station stairclimbing exercise type machine illustrating the pivoted arm steps, the housing, the hand rails and the instrument cluster.

Referring now to FIG. 2A, a single station prior art exercise device, here illustrated at 50, includes the same type of stairclimbing apparatus within housing 52 in which extending from the housing are pivoting arms 54 and 56. Here it can be that the hand rails 58 and 60 are to either side of the single station exercise platform, whereas the instrumentation is conveniently carried between rails 58 and 60 as illustrated by display 62.

The prior art single station device suffers from the aforementioned lack of social or competitive stimulus for the user of the machine, as well as the cost of providing for a safe platform on which to exercise, due to the weight of the components necessary in the exercise device, when contemplated for single station use.

Figure 2B:
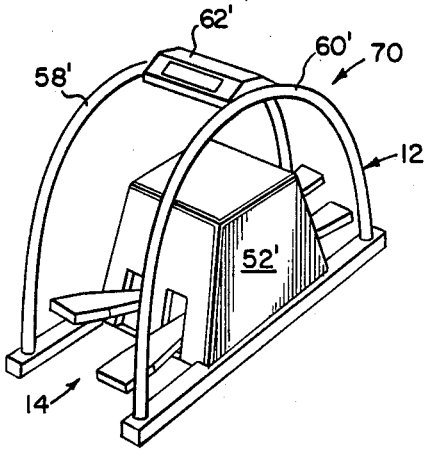
FIG. 2B is a diagrammatic illustration of a dual station stairclimbing exerciser embodiment, illustrating the dual facing diammetrically opposed facing exercise stations.

Referring to FIG. 2B, a dual facing diammetrically-opposed exercise station equivalent of the apparatus of FIG. 2A is shown by reference character 70 to include the aforementioned exercise or exercise stations 12 and 14 with the advantages being those described in connection with FIG. 1. Here only slightly larger housing 52' replaces the housing 52 of FIG. 2A, whereas only a slight amount more material for the spaced apart arcuate hand rails here shown at 58' and 60' is necessary in order to complete the dual facing device. More particularly, a single housing 62' may be utilized for the instrumentation, thereby affording the aforementioned cost savings.

Figure 3A:
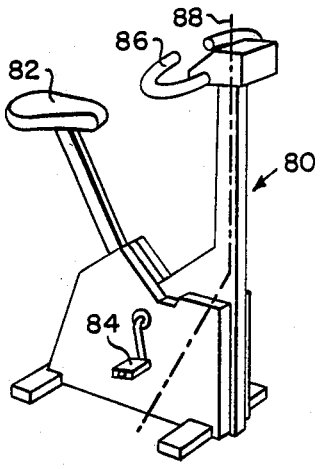
Fig. 3A (PRIOR ART)
FIG. 3A is a diagrammatic illustration of a single station bicycle type exercise device.

Referring now to FIG. 3A a bicycle type exercise device is illustrated by reference character 80 as including a seat 82 and pedal 84, with handle bars 86 providing support and with an instrumentation cluster 88 providing the user with an indication of the status of his exercise.

In order to accommodate the aforementioned social and competitive advantages, while at the same time providing for double the number of exercising individuals within a limited space, the standard exercise bicycle can be duplicated as illustrated by the device illustrated at 80' to include a housing 90 in which a common housing supports opposed seats 82' and 82'' associated pedals 84' and 84'', an upstanding support member 92, a single housed instrument cluster 94, and two sets of handle bars 96 and 98.

As will be appreciated not only have the number of users been doubled, not only are they at dual facing diammetrically-opposed exercise stations, the device when providing stations facing in such a manner can provide for either independent exercise or for coupled exercise while at the same time providing increased safety due to the increased mass of the structural housing and components for the dual station machine. It will however be appreciated that the amount of mass necessary is not double that of a single station machine; but is rather only a fraction thereof due to the common frame structure which holds the remainder of the components, and also due to the commonality of, for instance, the torqueing or braking apparatus contained by the machine.

Figure 4A:
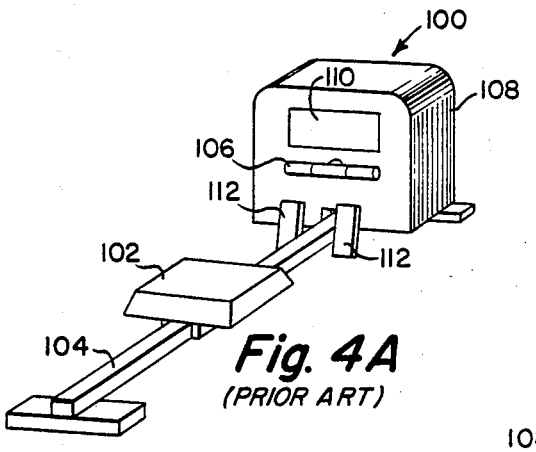
Fig. 4A (PRIOR ART)
FIG. 4A is a diagrammatic illustration of a prior art single station, rowing type exercise device.

Referring to FIG. 4A, a typical prior art rowing machine of a single station variety is illustrated by reference character 100 to include a seat 102 translating on a beam 104, with a handle 106 coupled to an internal fly wheel (not shown) within housing 108, with a display 110 displaying the exercise accomplished during the rowing sequence. It will be noted that foot rests 112 are provided for the appropriate rowing exercise.

Figure 3B:
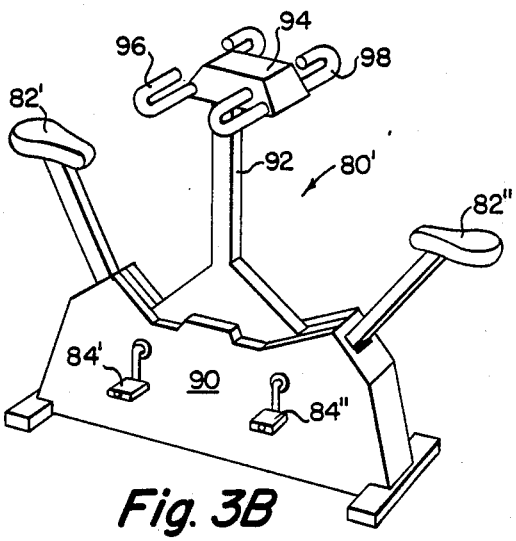
FIG. 3B is a diagrammatic illustration of a dual facing diammetrically-opposed embodiment of the FIG. 3A single station bicycle type exercise device.
Figure 4B:
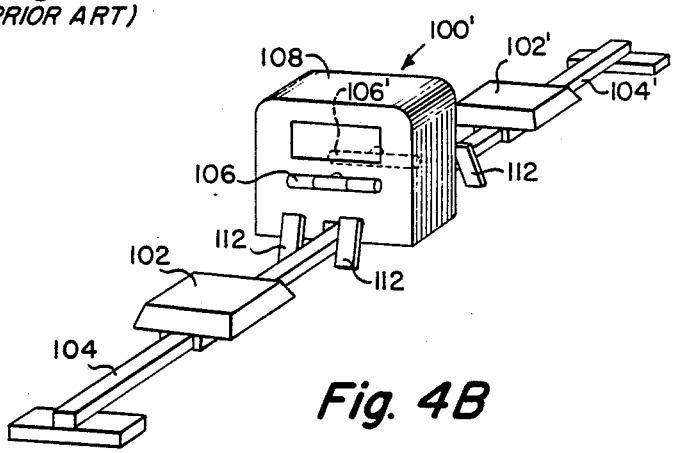
FIG. 4B is a diagrammatic illustration of a dual facing diammetrically-opposed embodiment of the FIG. 4A single station rowing type exercise device.

Referring now to FIG. 4B, a dual station machine 100' is provided with seats 102 and 102', with handles 106 and 106', and with housing 108 housing the common elements for this type of exercise machine. It will be noted that seats 102 and 102' ride along beam 104 and 104', with foot rests 112 being duplicated on the other side of the machine as illustrated at 112'. In this instance not only is the rowing to be made competitive through the visualization of the participant across the housing 108, it also provides a new type of competitive exercise, because, unlike the normal rowing scenarios, the competitive rowers can immediately view their opponents and the condition thereof. While the above applies to rowing machines it also applies both to the exercise bicycle embodiment of FIG. 3B, as well as to the stairclimbing embodiment of FIG. 2B.

Figure 5A:
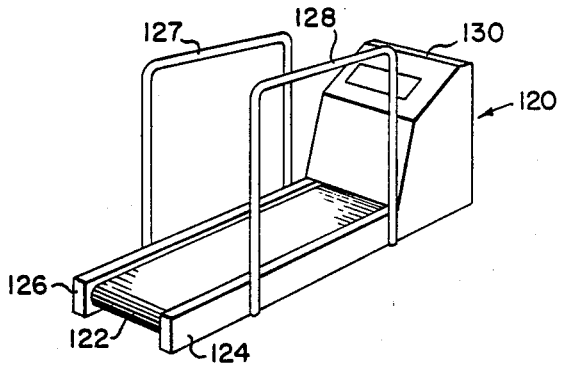
Fig. 5A (PRIOR ART)
FIG. 5A is a diagrammatic illustration of a prior art single station treadmill type exercise device.

Referring now to FIG. 5A what is depicted here is a standard prior art treadmill exercise machine generally indicated by reference character 120 to include a driven belt 122 housed within opposed rails 124 and 126, with the machine being provided with hand rails 127 and 128 as illustrated. At the head of the machine is a control console 130 which dictates the speed of the belt and indicates to the user of this single station machine the amount of his exercise, as well as the speed of the belt and/or its inclination.

Figure 5B:
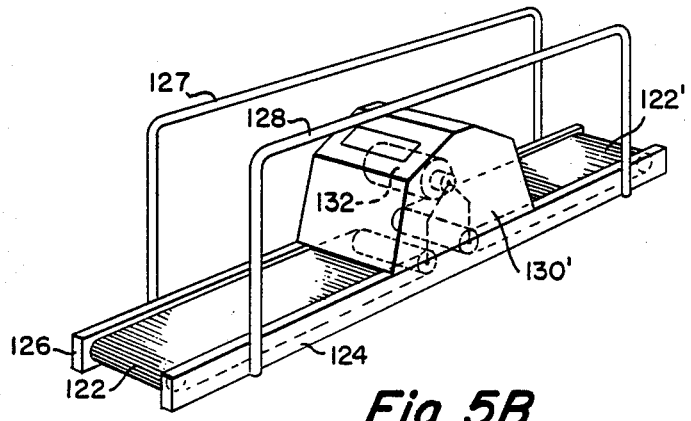
FIG. 5B is a diagrammatic illustration of a dual facing diammetrically-opposed embodiment of the FIG. 5A single station treadmill type exercise device.

Referring to FIG. 5B, the single station apparatus of FIG. 5A is again duplicated with belt 122 being duplicated on a diametrically opposite position 122' and with the head rails 127 and 128 being elongated so as to accommodate opposed exercise individuals located on the respective treadmills. The base rails 124 and 126 are elongated so as to accommodate the dual treadmill belts. Here it can be seen that housing 130' can house a single motor shown in dotted outline at 132 which may be connected through various clutch and torque converting means to drive the two opposed treadmills at different rates or indeed at the same rate. Here it can be seen quite simply that a single component may be utilized to drive the belts, which results in both cost savings and weight savings.

Thus, while in the past it has been possible to provide simulated competitive arenas for the individuals on single station machines, in one of its broad aspects the subject invention provides eye contact between dual facing exercisers so that it is not necessary to simulate on a display the action of the competitive individual. Rather the action of the competitive individual can be visually ascertained by the other person exercising.

Whether this results in social behavior or competitive behavior, it is the opposed dual facing stations which provide for either.

What will be appreciated is that the stations may be used individually without any social or competitive purpose, whereas the dual facing not only provides for the above-mentioned exercise features, it also provides for a format in which double the number of participants can participate in exercise within the same limited space as normally provided by health clubs.

As will be seen from the discussion of the following stairclimbing embodiment of the subject invention, not only can double the amount of participants be accommodated with the subject dual facing exercise station apparatus, this can be done at a fraction of the double cost which would be expected by merely duplicating the single station machine and placing it back to back.

Figure 6A:
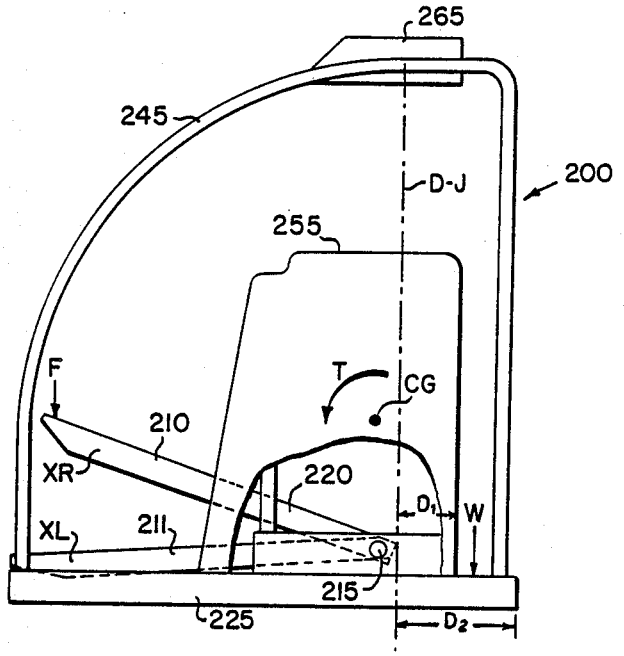
Fig. 6A (PRIOR ART)
FIG. 6A is a side and diagrammatic view of a prior art stairclimbing exercise device illustrating components and torques associated with the utilization of such a single station exercise machine.
Figure 6B:
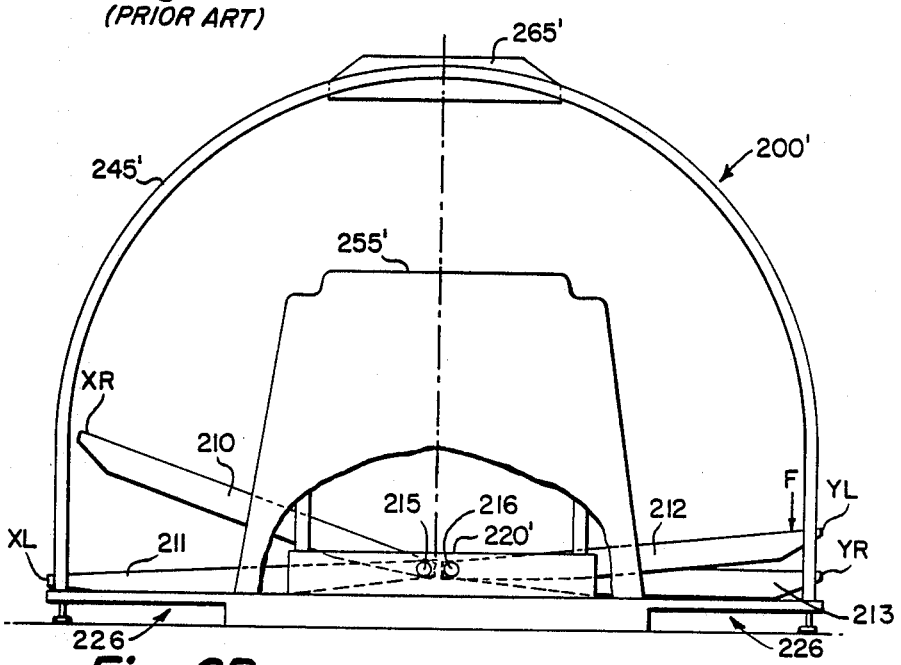
FIG. 6B is a side and diagrammatic illustration of a dual facing diammetrically-opposed embodiment of the single station device of a FIG. 6A, illustrating commonality of structural components and the ability to minimize costs through the sharing of structural components.

Referring now to FIG. 6A this figure depicts the aforementioned single station staircase exercise device 200 and in FIG. 6B a dual facing version 200'. FIG. 6A thus depicts a single station rotating arm stairclimber. The user's feet contact the machine at the ends $X_L$ and $X_R$ of arms 210 and 211. The arms rotate around shaft 215. The exercise torque, which is the product of the user's weight and acceleration times the distance between foot contact position XL and XR and the point of rotation 215, is counteracted by the shaft plate 220. Because of the amount of torque, T, about center of gravity, to be counteracted, the shaft plate is continued rearward of the shaft a distance $D_1$.

Other major components are base weldment 225; rail 245; mechanism housing 255; and instrument housing 265. The plane of division and junction is represented by line D-J. FIG. 6B is the dual station machine 200' obtained by components that are symmetrical analogs of the single station components swung around line D-J. The details of these major components are covered below.

It is noted that the joining yields a second operator station $Y_L$ and $Y_R$. The joining eliminates the need for the $D_1$ portion of shaft plate 220 on the single station machine. A second shaft 216 is needed on the dual station machine as are additional arms 212 and 213. Note that in FIG. 6B a major part 226 of weldment 225 can be removed because of the weight distribution in the dual machine. With the joined machine's center of gravity operating further away from the user, the machine's feet can be moved to a point in front of F rather then behind F without fear of tipping forward. Weldment portion 226 outboard of feet then serves no anti-torque function and can be eliminated or used for another purpose at reduced strength.

Figure 7A:
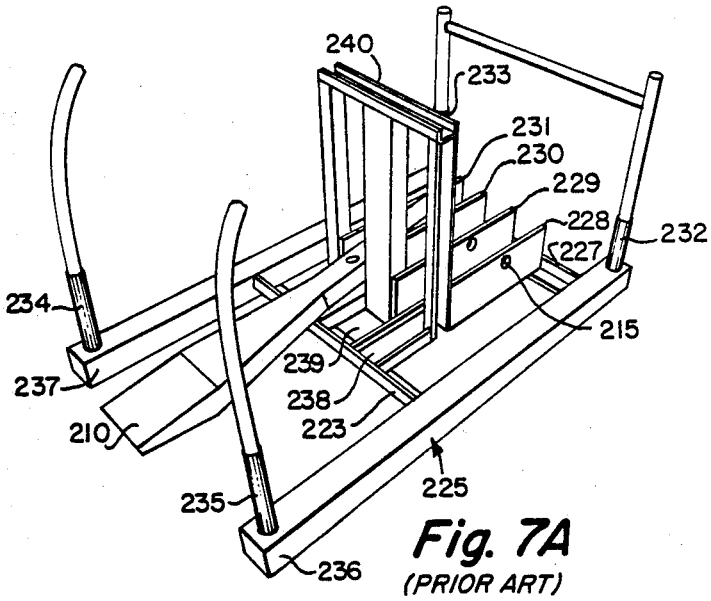
Fig. 7A (PRIOR ART)
FIG. 7A is a diagrammatic illustration of the weldment and interior portion of the single station exercise machine of FIG. 6A, showing the base weldment, of the major structural component thereof.
Figure 7B:
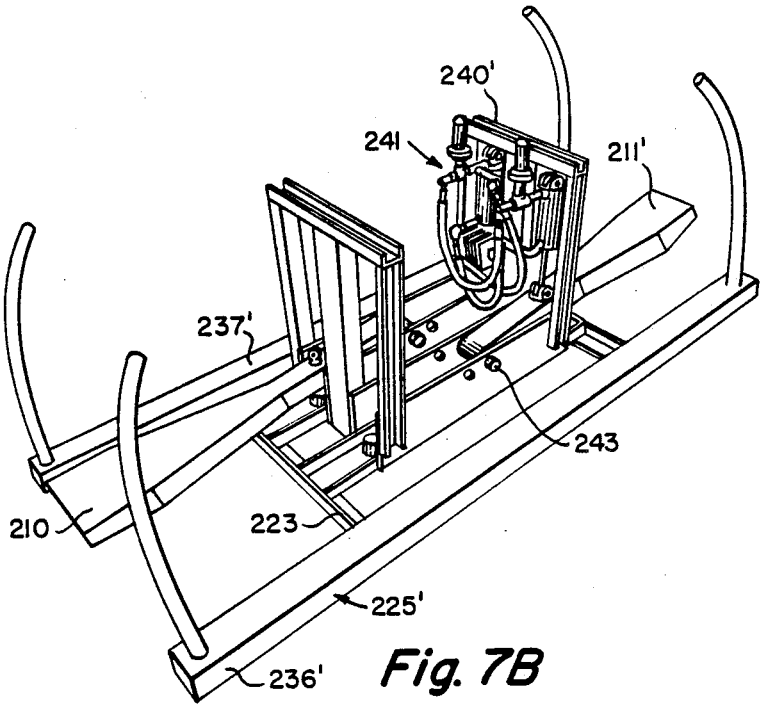
FIG. 7B is a diagrammatic illustration of a dual facing diammetrically-opposed station embodiment of the apparatus of FIG. 7A showing the utilization of a large portion of the weldment of the FIG. 7A single station device in the dual station embodiment.

FIG. 7A depicts the single station stairclimber's major structural component. It is the base weldment 225 identified in FIG. 6A. The weldment's major components are tubes 236 and 237 joined together by front angle 223 and rear angle 227 which support channels 238 and 239 to which upstanding longitudinally running shaft plates 228, 229, 230, and 231 are attached. Arm 210 rotates around shaft 215 and are hung from support 240 by hydraulic cylinders 241 as shown in FIG. 7B. The torque resulting from the user applying weight and accelerating force at the end of the arm 210 results in a torque that pulls support 240 down and lifts shaft 215 up. This torque is countermanded first by the shaft plates 228, 231 and channels 238 and 239, then by the front angle 223 and rear angle 227, and through their attachment to tubes 236 and 237 to the ground. The weldment also provides anchoring posts 232, 233, 234, 235 for attaching the rails.

FIG. 7B is the dual station machine base weldment. To be noted is that a second support 240' is the one additional part required in the dual station weldment. One additional hole 243 is required in the shaft plates. The shaft plates, channels, and tubes are fractionally longer but except for the shaft hole, require no more manufacturing operations than the single station components. The front and back angles and rail support posts are identical to those of the single station machine. It is to be noted that due to the longer shaft plates and channels, the torques applied to the cross angles and tubes is less in the dual station machine than in the single station machine.

Figure 8A:
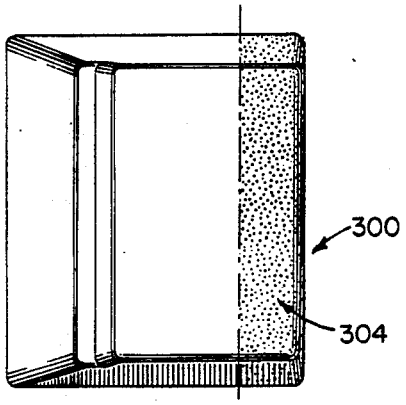
FIGS. 8A, 8B and 8C illustrate respectively the top, side and back views of the housing required for the single station embodiment of FIG. 6A.
Figure 8B:
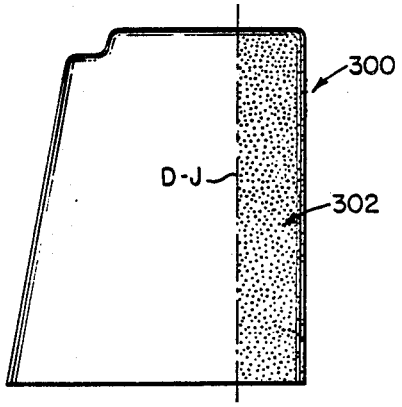
Figure 8C:
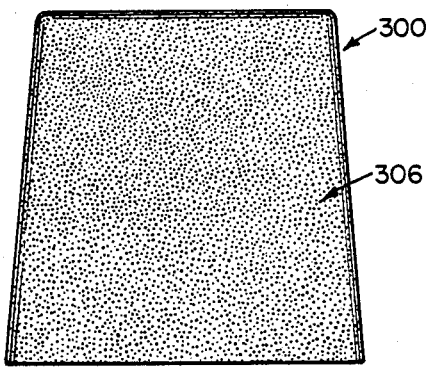

FIGS. 8A, B and C are drawings of the top, side and back of the mechanism housing 300 of a single station climber. The division D-J results in the shaded portions 302 of the single case that can be eliminated when combining two of the remaining pieces to form a dual mechanism housing. It is worthy of note that the eliminated side portions 302, plus the eliminated top portion 304, plus the eliminated back 306 represent a major portion of the single station mechanism housing.

Figure 8D:
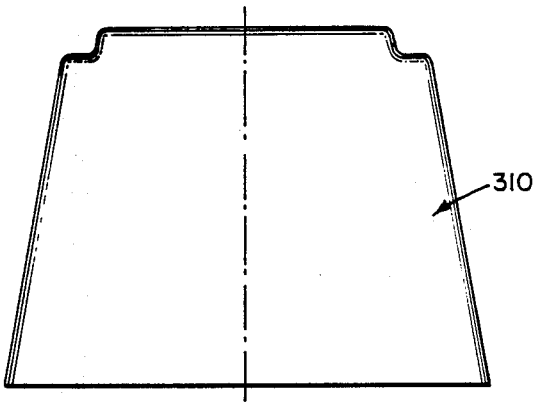
FIG. 8D illustrates a side view of the housing required for the dual station embodiment illustrated in FIG. 6B.

FIG. 8D is a drawing of the mechanism housing 310 of a dual station climber. These mechanism housings are generally produced by moulding or forming. The time of manufacture for either process is dependent upon the thickness of the material rather than the area. Consequently the manufacturing time for the single station and dual station housings will be the same.

The cost of the material for the same thickness is proportional to the area. However, with the area of the dual station mechanism housing being only fractionally more than that of the single, and the manufacturing time the same, the cost of the dual housing is only fractionally larger than the cost of the single station housing.

Figure 9A:
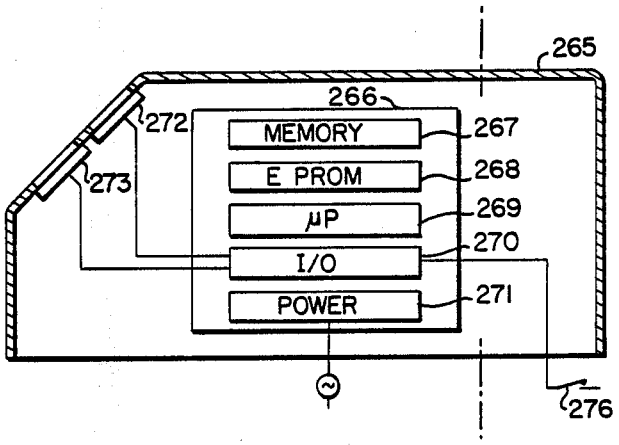
Fig. 9A (PRIOR ART)
FIG. 9A is a diagrammatic representation of the instrumentation required for the single station exercise device of the FIG. 6A; and, FIG. 9B is a diagrammatic illustration of the instrumentation for the dual facing diammetrically-opposed embodiment of the FIG. 6B.

FIG. 9A is a schematic representation of the single station climber's instrument and case 265. The case 265 covers, mounts, and protects circuit board 266, which carries a memory 267, and E Prom 268, microprocessor 269, and I/O 270, and a power supply 271, display 272, and user keyboard 273. A microprocessor 269 uses an algorithm stored in the Eprom 268 to evaluate information received through the I/O 270 from the activity sensor 276 and user keyboard 273 to calculate and display such exercise information as exercise intensity, calories burned, time etc. Power regulation and long term memory are dictated by specific applications.

Figure 9B:
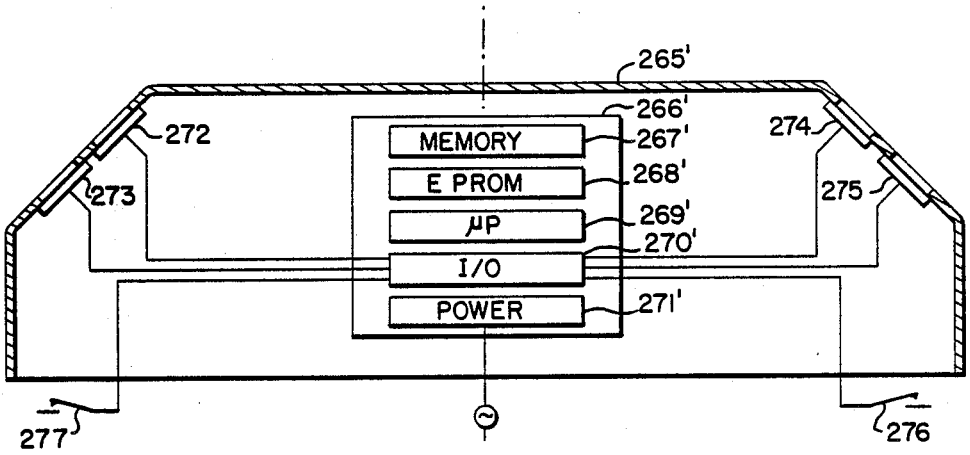

FIG. 9B is a schematic representation of the dual station climber's instrument. The instrument case 265' serves the same function for the instrument that the mechanism housing 255 serves for the mechanism and is generally manufactured of the same material as the housing, and by the same manufacturing process. As a result dual instrument case and electronics cost is only fractionally more expensive than the cost of a single station instrument case and electronics. It will be appreciated that the memory, E Prom, microprocessor, I/O, and power supply are identical to the components noted in FIG. 9A with the exception that their reference characters bear the prime notation.

The dual station instrument requires an additional display 274, user keyboard 275 and activity sensor 277. The independent or interactive handling of two exercisers can be done by the single machine circuitboard. With the same circuit board, a fractionally more expensive case, and one each additional activity sensor, display and input keyboard, the dual station climber instrument is significantly less expensive than two single station instruments.

What is also important is that one controller can effectuate the aforementioned interactive or competitive exercise; or allow complete independence of exercise.

Having above indicated a preferred embodiment of the present invention, it will occur to those skilled in the art that modifications and alternatives can be practiced within the spirit of the invention. It is accordingly intended to define the scope of the invention only as indicated in the following claims:

What is claimed is:

1. A dual facing stair climbing exercise device having dual facing diametrically opposed exercising position at which users can exercise, said dual facing stair climbing exercise device comprising:

a base having upstanding longitudinally running and centrally located members;

two pairs of reciprocating pivoted stair step lever arms;

means for pivoting said two pairs of stair step lever arms on said base from a central location along the longitudinal length of said base such that each of said pairs of stair step lever arms outwardly extended in opposite directions, wherein said upstanding members having two pairs of apertures therethrough said central location and said pivoting means in said apertures for pivoting said each pairs of stair step lever arms;

means connected to said base for phasing said pairs of stair step lever arms; and a pair of spaced apart arcuate hand rails, each end of said arcuate hand rails anchored at said base such that said arcuate hand rails straddle said outwardly extended stair step lever arms to form an extremely stable hand rails and to provide a rigid structure for said dual facing stair climbing exercise device.

2. The exercise device of claim 1, wherein said phasing means includes hydraulic phasing means mounted to said base.

3. The exercise device of claim 1 and further including instrumentation for said exercise device mounted centrally at the top of and between said arcuate hand rails.

* * * * *